US007984673B2

(12) United States Patent
Rousseau

(10) Patent No.: US 7,984,673 B2
(45) Date of Patent: Jul. 26, 2011

(54) INKING DEVICE ADJUSTMENT METHOD

(75) Inventor: Nicolas Rousseau, Chantilly (FR)

(73) Assignee: Goss International Montataire SA, Montataire (FR)

( * ) Notice: Subject to any disclaimer, the term of this patent is extended or adjusted under 35 U.S.C. 154(b) by 467 days.

(21) Appl. No.: 11/640,416

(22) Filed: Dec. 15, 2006

(65) Prior Publication Data

US 2007/0151470 A1 Jul. 5, 2007

(30) Foreign Application Priority Data

Dec. 23, 2005 (FR) ..... 05 13273

(51) Int. Cl.
*B41F 31/00* (2006.01)

(52) U.S. Cl. ..... 101/350.1; 101/331; 101/351.1; 101/352.01; 101/367

(58) Field of Classification Search ..... None
See application file for complete search history.

(56) References Cited

U.S. PATENT DOCUMENTS 2,568,761 A * 9/1951 Peyrebrune ..... 101/218
3,869,984 A * 3/1975 Toth ..... 101/350.3
4,063,504 A * 12/1977 Ottenhues et al. ..... 101/247
4,530,285 A * 7/1985 Fischer ..... 101/365
5,052,297 A * 10/1991 Albiez ..... 101/365
5,355,796 A 10/1994 Koebler et al.
5,445,076 A * 8/1995 Sugiyama et al. ..... 101/218
5,740,736 A * 4/1998 Toyoda ..... 101/218
5,967,049 A * 10/1999 Seymour et al. ..... 101/365
6,347,585 B1 * 2/2002 Kiamco et al. ..... 101/351.1
6,460,455 B1 * 10/2002 Eltner et al. ..... 101/148
6,712,001 B2 * 3/2004 Plewa ..... 101/218

FOREIGN PATENT DOCUMENTS

GB 2 411 150 A 8/2005

* cited by examiner

*Primary Examiner* — Jill E Culler
(74) *Attorney, Agent, or Firm* — Davidson, Davidson & Kappel, LLC

(57) ABSTRACT

An inking device of a printing unit includes an ink reservoir, an ink film pick-up roller which has a shaft, and an inking roller having a shaft.

A detector detects the distance between the inking roller and the pick-up roller and/or an angular displacement of the two shafts relative to each other and providing an output signal which represents this distance and/or this angular displacement. A controller angularly the second shaft relative to the first shaft, and the controller is capable of reducing the angular displacement and of positioning the pick-up roller in accordance with the output signal.

21 Claims, 5 Drawing Sheets

INKING DEVICE ADJUSTMENT METHOD

This claims priority to French patent application number 0513273, filed Dec. 23, 2005, and hereby incorporated by reference herein.

The present invention relates to an inking device of a printing unit, of the type comprising:

a reservoir of ink, an ink film pick-up roller having a first shaft, and an inking roller which defines a printing width and which is capable of transferring ink from the ink reservoir to the ink film pick-up roller and which has a second shaft.

It is used in particular in printing units of rotary offset presses.

BACKGROUND

Inking devices are known from the prior art which comprise an ink reservoir, an ink film pick-up roller which is capable of transferring ink to a distributor roller, and an inking roller which is capable of transferring ink from the ink reservoir to the ink film pick-up roller.

The positioning of the ink film pick-up roller relative to the inking roller is a very complex adjustment operation since it determines the homogeneity of the supply of ink to the medium to be printed which is generally constituted by a web of paper to be printed.

In order to be able to adjust the supply of ink, the ink film pick-up roller has a shaft which can be moved relative to the shaft of the inking roller. The inking devices are also provided with means for fixing the shaft of the ink film pick-up roller relative to the shaft of the inking roller.

Generally, the distance between the inking roller and the ink film pick-up roller is adjusted by shims. Shims having a specific thickness are moved in a sliding manner between the inking roller and the ink film pick-up roller. The position of the ink film pick-up roller (also referred to as "pick-up roller") is adjusted so that it is in contact with these shims when it is in position during a printing operation. The ink film pick-up roller is then fixed in position and the shims are removed.

When the operator observes a non-uniform supply of ink over the printing width, he moves the shaft of the pick-up roller so that it is parallel with the shaft of the inking roller and adjusts it again using the shims.

This adjustment has the disadvantages of being imprecise and being susceptible to the subjectivity of the operator.

SUMMARY OF THE INVENTION

An object of the invention is to overcome the disadvantages mentioned and to provide an inking device which allows a more reliable and simple adjustment in order to provide a regular supply of ink.

To this end, the invention provides an inking device including a detector capable of evaluating the actual distance between the inking roller and the ink film pick-up roller within the printing width and/or of detecting an angular displacement of the two shafts relative to each other and providing an output signal which represents this angular displacement.

According to specific embodiments, the inking device may comprise one or more of the following features:

the inking device controllers capable of angularly displacing the second shaft relative to the first shaft, and controllers capable of reducing the angular displacement in accordance with the output signal;

the inking device comprises controllers capable of positioning the ink film pick-up roller relative to the inking roller in accordance with the output signal;

the detector comprises at least one sensor which is capable of indicating the density of the ink printed on a medium to be printed in at least two different locations over the printing width;

the inking device comprises at least two screws for adjusting the thickness of ink on the inking roller;

the detector is capable of detecting the position of the adjustment screws;

the detector is capable of detecting the position of at least one of the adjustment screws corresponding to the lithographic offset;

the inking device further comprises a memory capable of storing a value which represents the lithographic offset position in the memory when the shafts of the inking roller and pick-up roller are parallel;

the controller comprises a first motor and a first transmission capable of transmitting a driving action of the first motor into an angular displacement of the first shaft relative to the second shaft;

the controller comprises a second motor and a second transmission capable of transmitting a driving action of the second motor into an angular displacement of the first shaft relative to the second shaft; and the first transmission being capable of displacing one end of the pick-up roller radially relative to the second shaft.

The invention also provides a method for adjusting a printing unit comprising the following steps:

determining the actual distance between the ink film pick-up roller and inking roller at least at two points of the printing width and/or determining the actual angular displacement of the first shaft and second shaft relative to each other, and displacing the first shaft relative to the second shaft by reducing the actual angular displacement and/or by modifying the relative radial position of the first shaft relative to the second shaft.

According to a specific embodiment, the method comprises the following steps:

verifying whether the actual angular displacement is greater than a threshold displacement and/or verifying whether the actual distance is greater than a threshold distance, implementing the displacing step only when the actual angular displacement is greater than the threshold displacement and/or when the actual distance is greater than the threshold distance;

after the displacing step, determining the lithographic offset of at least one adjustment screw; and storing the lithographic offset determined in this manner in a memory.

BRIEF DESCRIPTION OF THE DRAWINGS

The present invention will be better understood from a reading of the following description, given purely by way of example and with reference to the appended drawings, in which.

DETAILED DESCRIPTION OF PREFERRED EMBODIMENTS

Figure 1:
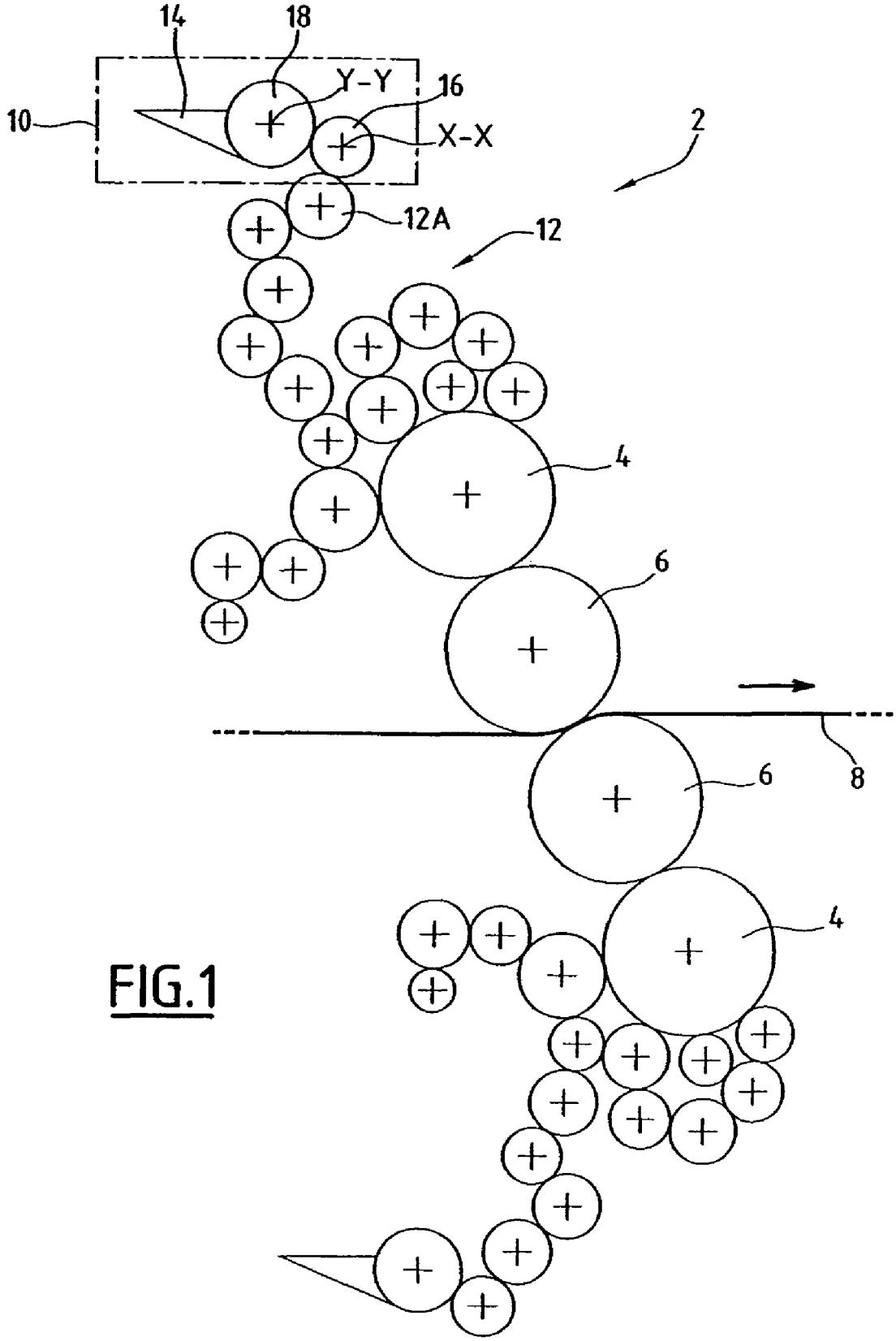
FIG. 1 is a schematic side view of a printing unit according to the present invention.

FIG. 1 illustrates a printing unit according to the invention, generally designated 2.

The printing unit 2 comprises a plate cylinder 4 and a blanket cylinder 6 which is capable of printing an image on a web 8 of paper which forms a medium to be printed.

The printing unit 2 is provided with an inking device 10, and a plurality of distributor rollers 12.

The inking device 10 is provided with an ink reservoir 14, an ink film pick-up roller 16 which can be rotatably moved about a first shaft X-X, and an inking roller 18 which is capable of transferring ink from the ink reservoir 14 to the pick-up roller 16 and which can be rotatably moved about a second shaft Y-Y.

Figure 2:
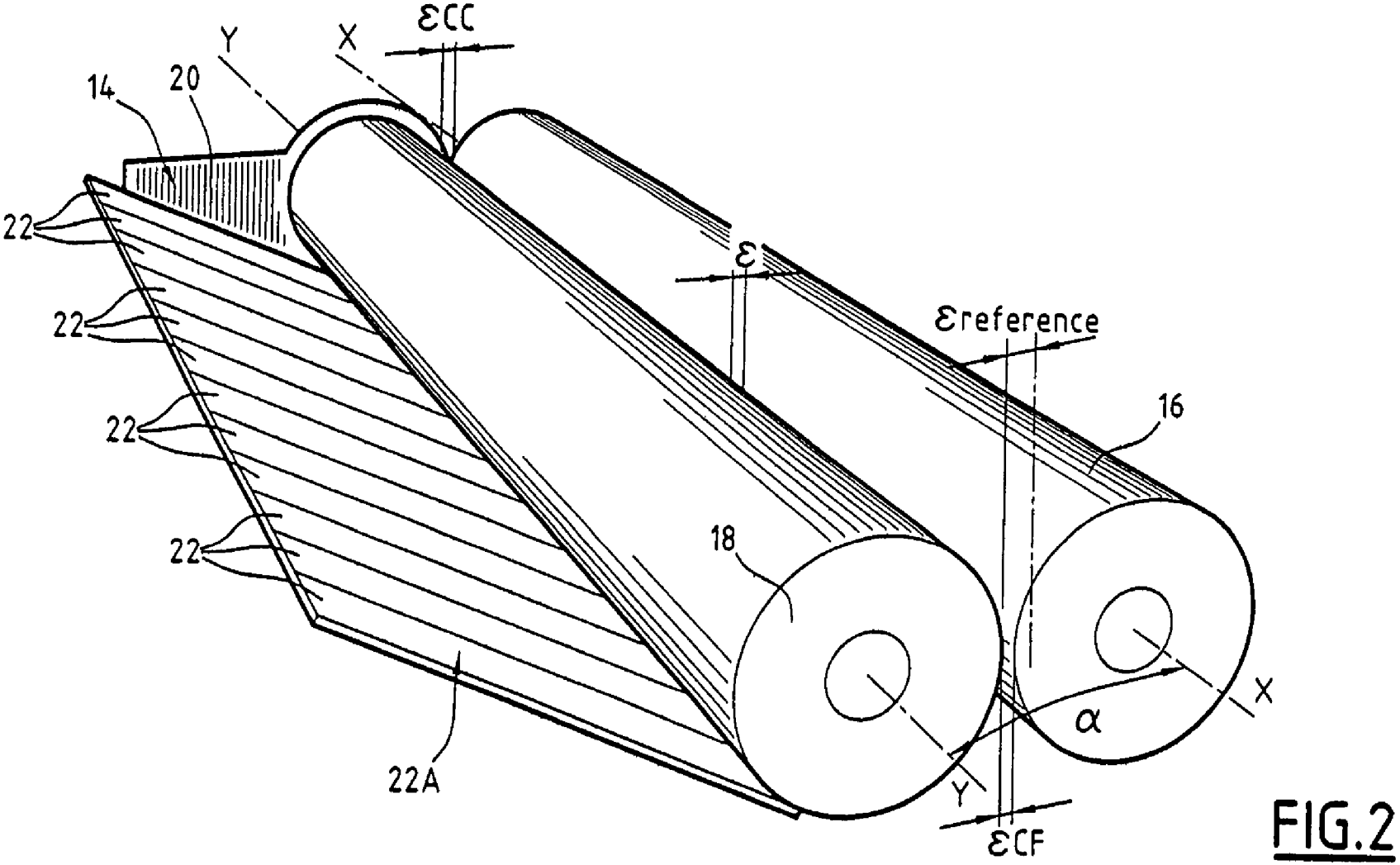
FIG. 2 is a perspective view of a portion of an inking device according to the present invention.

As illustrated in FIG. 2, the ink reservoir 14 comprises two lateral plates 20, one of which is illustrated, and a plurality of adjustment screws 22 which can be moved and which allow the thickness of the ink transferred from the ink reservoir 14 to the inking roller 18 to be adjusted locally.

Figure 3A:
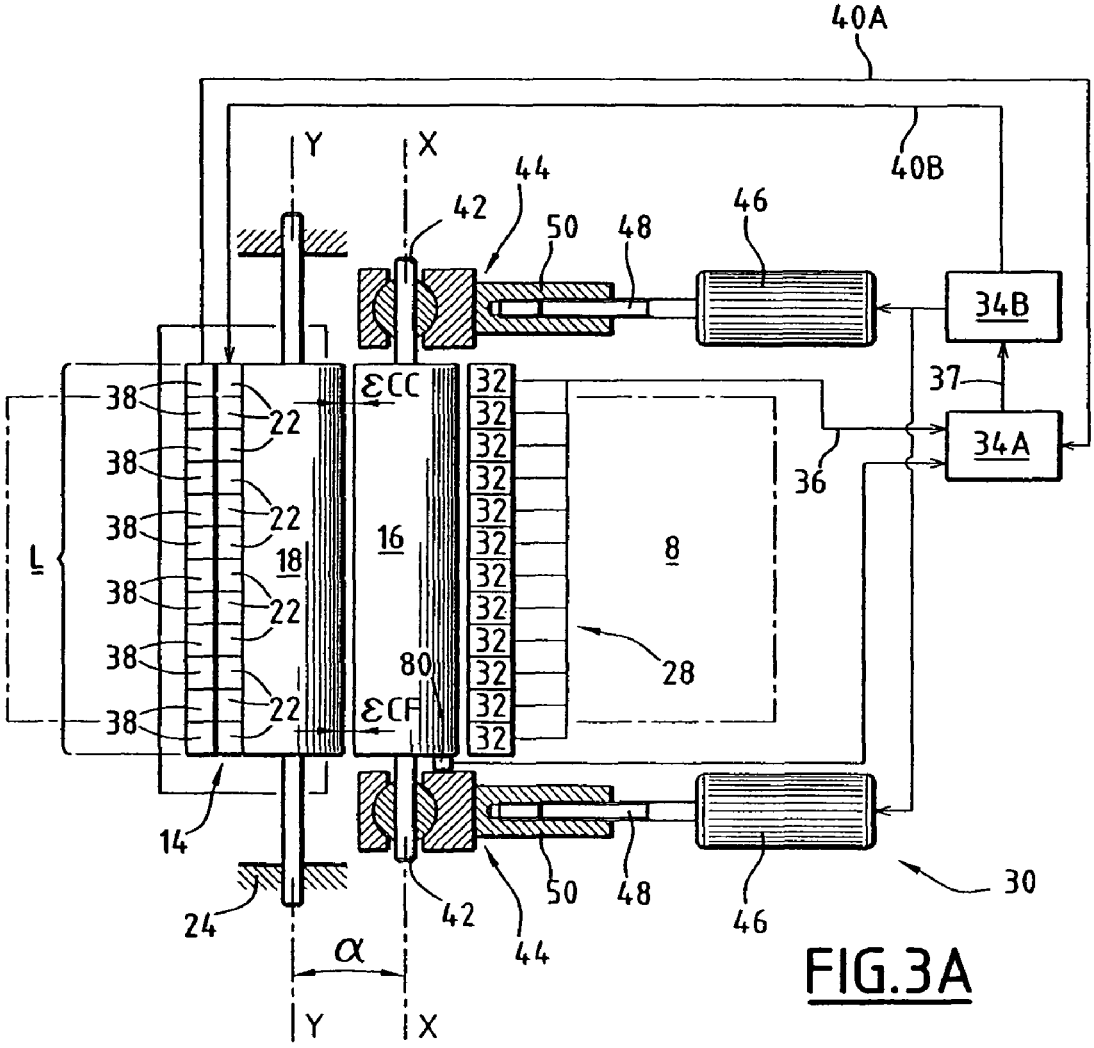
FIG. 3A is a schematic top view of an inking device according to a first embodiment of the present invention.

As can be seen from FIG. 3A, the inking roller 18 is arranged in a printer chassis 24, so that the shaft Y-Y thereof is fixed. The inking roller 18 defines a printing width L which extends parallel with the shaft Y-Y.

The inking device 10 also defines the following values:

Distance $\epsilon$: the distance $\epsilon$ is the distance between the pick-up roller 16 and the inking roller 18 at a given axial location. The operating side distance $\epsilon$CF is the actual spacing between the pick-up roller 16 and the inking roller 18 at an axial end and the control side distance $\epsilon$CC is the actual spacing between the pick-up roller 16 and the inking roller 18 at the other axial end (see in particular FIG. 2).

Lithographic Offset: the lithographic offset or lithographic displacement of an adjustment screw 22 is the position of the adjustment screw 22 at which the thickness of the ink transferred to the inking roller 18 is equal to the distance between the inking roller 18 and the pick-up roller 16, at the axial position of the associated adjustment screw 22. For example, for the adjustment screw 22A of FIG. 2, it is the position at which the thickness of ink on the inking roller 18 is equal to the spacing $\epsilon$CF.

The distance $\epsilon_{reference}$ is the distance required between the inking roller 18 and the pick-up roller 16 in order to bring about optimum adjustment behaviour of the adjustment screws 22. This distance is predetermined for a specific printing command.

The inking device 10 according to the invention is provided with a detector 28 which is capable of detecting an angular displacement of the two shafts X-X and Y-Y relative to each other. The inking device 10 is further provided with a controller 30 which is capable of angularly displacing the first shaft X-X relative to the second shaft Y-Y.

The detector 28 comprises a plurality of sensors 32 which are capable of indicating the density of the ink printed on the printing medium 8, at different locations over the printing width L.

The detector 28 further comprises a first microcontroller 34A to which the sensors 32 are connected by a detection line 36.

The detector 28 is provided with a plurality of sensors 38 which are capable of detecting the position of each of the adjustment screws 22 of a detection line 40A which is connected to the first microcontroller 34A.

The first microcontroller 34A is capable of calculating and providing an output signal to the controller 30 via an output line 37. This output signal represents the angular displacement of the shaft X-X relative to the shaft Y-Y.

As can be seen in FIG. 3A, the ink film pick-up roller 16 comprises at each end a pin 42 having a shaft X-X. The controller 30 comprises a second microcontroller 34B to which the first microcontroller 34A is connected via the line 37. This second microcontroller 34B is capable of receiving the signal representing the positioning of the ink film pick-up roller 16 and in particular the angular displacement of the two shafts X-X and Y-Y. The output signal also represents the distance $\epsilon$ between the ink film pick-up roller 16 and the inking roller 18 and in particular at least at two locations over the printing width L. In this instance, these distances are $\epsilon$CC and $\epsilon$CF at the two ends of the printing width L.

The controller 30 comprises two motors 46 and a transmission device which are formed by a threaded rod 48 which is received in a tapped bush 50 which is fixed to a ball and socket joint 44.

Each pin 42 is received to rotate freely in one of the ball and socket joints 44.

A transmission 42, 48, 50 is thus capable, for each of the motors 46, of transmitting the driving action of the associated motor 46 into an angular displacement of the first shaft X-X relative to the second shaft Y-Y. More precisely, the movement of the end of the ink film pick-up roller 16 is carried out radially relative to the second shaft Y-Y. The transmission device 42, 48, 50 is also capable of displacing the ink film pick-up roller 16 radially in terms of translation relative to the second shaft Y-Y, bringing about a simultaneous driving of the two motors 46.

The controller 30 further comprises a control line 40B which connects the second microcontroller 34B to each of the adjustment screws 22. The controller 30 is thus capable of controlling the position of the adjustment screws 22 by the second microcontroller 34B.

The inking device operates in the following manner.

When the printing unit 2 is in a state for printing a command, an image is printed on the web 8. This image has an actual density of ink which varies over the printing width L.

Firstly, the sensors 32 indicate this actual density of the ink printed on the web 8 at several locations which are distributed over the printing width L. Then, signals which represent the actual density of the ink at these locations are transferred via the line 36 to the first microcontroller 34A which calculates an adjustment screw 22 opening correction value required to reach a desired optical density at each of the locations. This is the typical operation of a system for continuously controlling the density of ink.

With the embodiment of FIG. 3A, the corrections of the opening are then sent to the adjustment screws 22 via the microcontroller 34B. When the range of the desired optical density of the ink has been reached, the positions of the adjustment screws 22 corresponding to the desired density of ink are sent to the microcontroller 34A.

Secondly, the microcontroller 34A calculates the displacement $\alpha$ between the shafts X-X and Y-Y and the actual spacing $\epsilon$ between the rollers 16 and 18.

Thirdly, the microcontroller 34B controls the motors 46 by reducing the angle $\alpha$ and by displacing the roller 16 so that the distance $\epsilon_{reference}$ is obtained.

This method of calculation and automatic control will be explained in greater detail with reference to the embodiment of FIG. 3B, but is also advantageous for the embodiment of FIG. 3A.

Figure 3B:
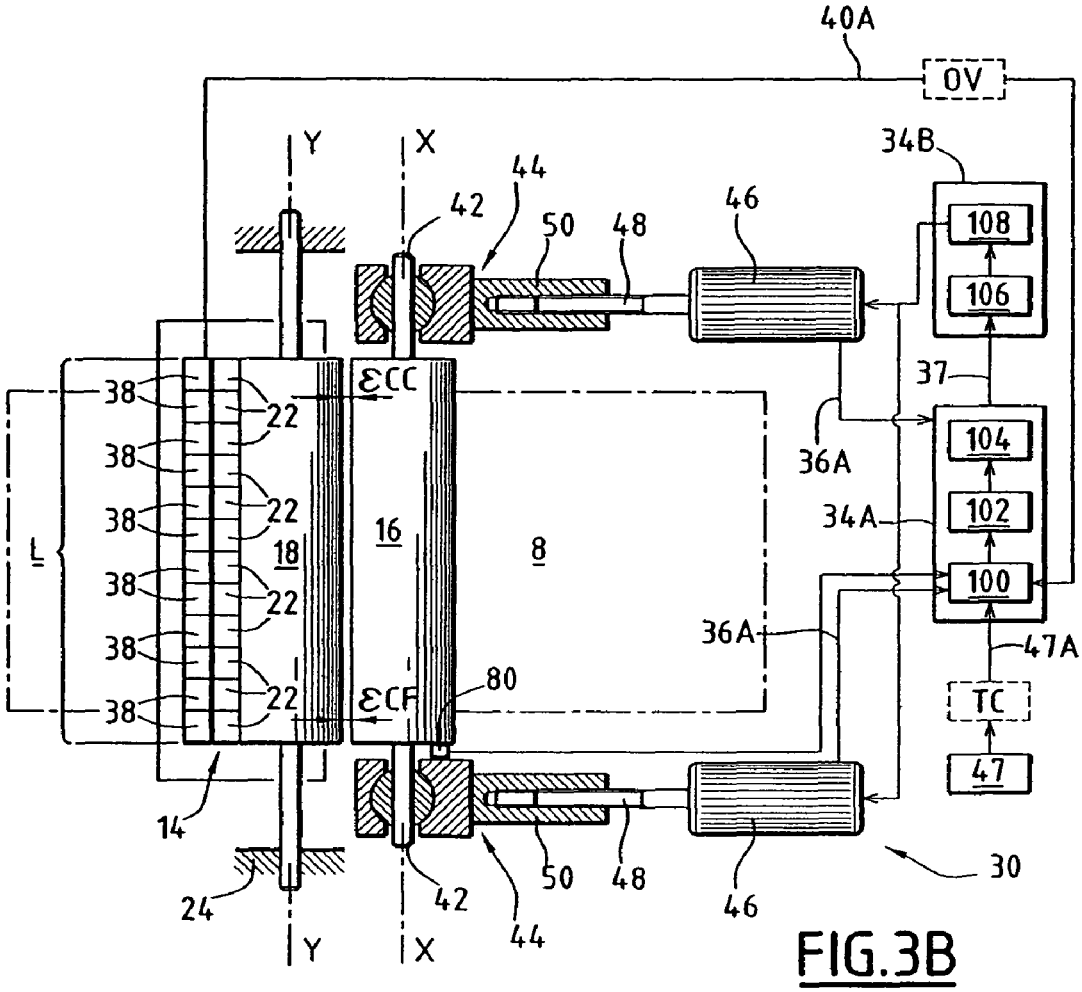
FIG. 3B is a schematic top view of an inking device according to a second embodiment of the present invention.

FIG. 3B illustrates a second embodiment of the inking device according to the invention.

Figure 4A:
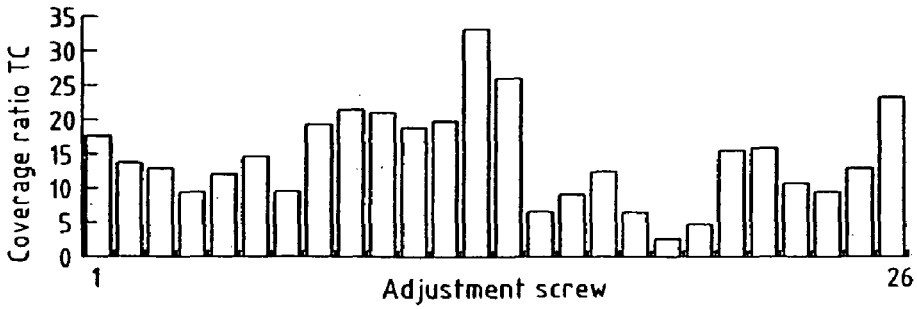
FIGS. 4A to 4C are charts illustrating parameters when inking devices according to the present invention are used.

This inking device comprises an additional memory 47 in which values are stored which represent the coverage ratio TC of the printing plate for each adjustment screw 22. This coverage ratio TC indicates the quantity of ink which has to be applied to the web in order to obtain a uniform actual density of ink over the printing width L. An example of these values for a device comprising 26 adjustment screws 22 is illustrated in FIG. 4A. For the first screw 22, the coverage ratio is approximately 18%.

This memory 47 is connected to the first microcontroller 34A by means of a line 47A and is capable of sending the values TC to the first microcontroller.

Furthermore, the sensors 32 and the detection line 36 are omitted. The operations for controlling and correcting the openings of the ink screws 22 are carried out not by a continuous control system using these sensors 32, but instead manually by an operator.

To this end, the operator modifies the opening of the adjustment screws 22 until the supply of ink to the web on the substrate is considered to be satisfactory. Then, the positions of the adjustment screws 22 corresponding to this target density of ink are sent to the microcontroller 34A via the line 40A.

Figure 4B:
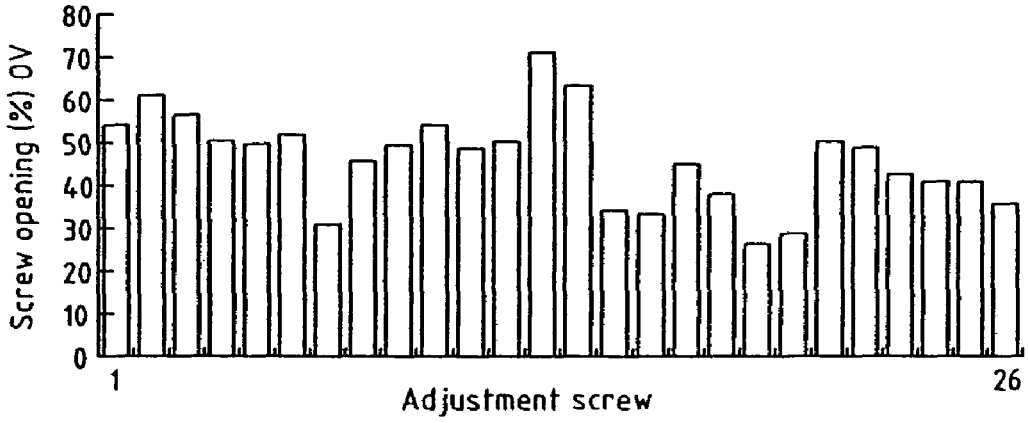

The data sent are illustrated in FIG. 4B. FIG. 4B illustrates, for screws 1 to 26, the opening OV of the adjustment screws. Screw number 1 is thus open to an extent of approximately 56%.

The calculation of the angular displacement a between the two shafts X-X and Y-Y is carried out in the following manner and will be explained below with reference to FIG. 3B.

The coverage ratios TC, that is to say, the quantity of ink required to provide a uniform printing density over the printing width when the printing is prepared. These data are sent to the first microcontroller 34-A via the control connection 47A. Furthermore, the values OV of the screw openings 22 are sent to the microcontroller 34A via the line 40A.

Furthermore, the microcontroller 34A obtains information relating to the rotation speed of the inking rollers 18, for example, using a sensor 80 and a line 81.

The microcontroller 34A then calculates, during a step 100, the lithographic offset OL per adjustment screw 22 for each ink in accordance with the following equation:

$$\textit{LithographicOffset OL} = \text{Screw opening } OV - \frac{Coeff \cdot \text{paper} \times Coeff \cdot \text{inking}}{\text{Inking roller speed}} \times \text{coverage ratio } TC$$

The values "Coeff.paper" and "coeff.inking" are predetermined constant values.

Figure 4C:
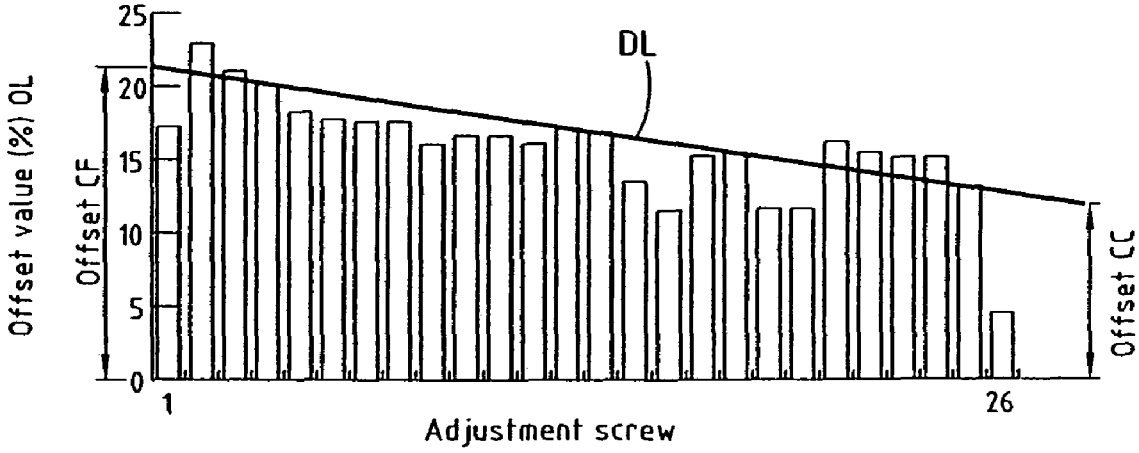

Offset values OL are thus obtained per adjustment screw 22, which is illustrated in FIG. 4C.

Ideally, the lithographic offset values are identical for all of the adjustment screws 22. In reality, they vary from one adjustment screw to the next in accordance with the angular displacement α between the shafts X-X and Y-Y.

Then, during a step 102, the offset values are converted into a linear line DL, for example, by means of linear regression. This line DL is inclined by an angle β relative to the X-axis. The line DL also defines an operating side lithographic offset OLCF and a control side lithographic offset OLCC at the two ends of the printing width L.

In a step 104, the lithographic offset values OLCF and OLCC are converted into the distances between the ink film pick-up roller 16 and the inking roller 18 at the two ends of the printing width ϵCF and ϵCC.

Since the lithographic offset value is proportional to the actual distance ϵ between the inking roller 18 and the ink film pick-up roller 16 at the location of the relevant adjustment screw 22, the following formula is used to this end:

$$\epsilon = a.\text{OffsetLithographic } OL[\%] + b \text{ where}$$

a and b are constant values characteristic of the opening of the inker and are determined for each inking device. a is, for example, equal to 0.6 and b is, for example, equal to 0.03 mm.

Furthermore, the actual angular displacement α between the shaft X-X and the shaft Y-Y is calculated in accordance with the following formula:

$$\alpha = \tan\left(\frac{\varepsilon CF - \varepsilon CC}{L}\right)^{-1}$$

This angular deviation α and/or the actual distances ϵCF and ϵCC of each end between the ink film pick-up roller 16 and the inking roller 18 are converted into a signal which is transmitted via the line 37 to the second microcontroller 34B.

During a step 106, the values ϵCF and ϵCC are compared with a reference value $\epsilon_{reference}$ which corresponds to parallel shafts X-X and Y-Y and preferably also to a distance between the rollers at which the lithographic offset values are identical to a reference lithographic offset.

In accordance with this comparison, during a step 108, one or both motors 46 are driven with the actual angular deviation being reduced until the shaft X-X is parallel with the shaft Y-Y and/or until the actual distance between the rollers is identical to the reference distance $\epsilon_{reference}$.

In a variant, one or both motors 46 are driven so that the actual angular displacement is reduced but not so far that the two shafts Y-Y and X-X become completely parallel.

In a variant, the angular deviation α, and therefore the actual angular displacement, is compared with a predetermined threshold angular displacement which is greater than 0°. Then, only when the angular deviation is greater than the threshold deviation, the angular displacement is reduced or brought to zero. Modification of a negligible occurrence of non-parallelism between the two shafts X-X and Y-Y is thus prevented.

Preferably, the controller 30 awaits the end of the current control operation before driving the motors 46. When the shaft X-X has been adjusted so as to be parallel with the shaft Y-Y, the following control operation can be started. Influencing a modification of the position of the adjustment screws 22 during the current control operation can thus be prevented.

An improved variant of the operating method of the inking device is as follows.

The respective offset values of each screw per inking operation, calculated according to the operating method above, are stored in a memory which is not illustrated for the last n printing commands.

Based on these values, the microcontroller 34A evaluates the values representative of the last n angular displacement operations between the shaft X-X of the pick-up roller 16 and the shaft Y-Y of the inking roller 18, and the distance ϵCC and ϵCF between the inking roller and the ink film pick-up roller at the two ends of the printing width. Signals representing these values are sent via the line 37 to the microcontroller 34B.

Then, the microcontroller 34B automatically controls the motors 46 in order to reduce the angular displacement α in a similar manner to that described above, and to position the ink film pick-up roller at the reference distance from the inking roller.

The reduction of the angular displacement α brings about a modification of the lithographic offsets of the adjustment screws 22. Consequently, with the inking device of FIG. 3A, once the shafts X-X and Y-Y are parallel, the microcontroller 34B adjusts each of the adjustment screws 22 to their new lithographic offset position. Then, this position is taken by the microcontroller 34A and stored in a memory which is not illustrated. In this manner, this new offset position stored is used to adjust the quantity of ink which has to be transferred to the pick-up roller 16.

According to a variant which is not illustrated, the output line 37 is connected to a display unit which is capable of displaying a displacement value which represents the angular displacement of the shafts X-X and Y-Y. According to this variant, the controller 30 is activated by an operator in accordance with the displayed value. In this embodiment, the controller 30 may comprise micrometer screws which replace the motors 46, the threaded rods 48 and the tapped bushes 50 of the embodiment described above.

What is claimed is:

1. A method for adjusting an inking device comprising the following steps:

providing a reservoir of ink and an ink film pick-up roller having a first shaft;

transferring ink using an inking fountain roller, which defines a printing width, from the ink reservoir to the ink film pick-up roller, the inking fountain roller being in contact with the ink in the reservoir and the ink film pick-up roller, the inking roller having a second shaft;

evaluating with a detector the actual distance between the inking fountain roller and the ink film pick-up roller within the printing width and/or of detecting an angular displacement of the first and second shafts relative to each other and providing an output signal representing the angular displacement;

determining the actual distance between the ink film pick-up roller and inking roller at least at two points of the printing width and/or determining the actual angular displacement of the first shaft and second shaft relative to each other;

displacing the first shaft relative to the second shaft by reducing the actual angular displacement and/or by modifying the relative radial position of the first shaft relative to the second shaft;

determining a lithographic offset value of at least one adjustment screw; and storing the lithographic offset value determined in this manner in a memory.

2. The method for adjusting an inking device as recited in claim 1 further comprising angularly displacing the second shaft relative to the first shaft via a controller, the controller being capable of reducing the angular displacement as a function of the output signal.

3. The method for adjusting an inking device as recited in claim 2 further comprising transmitting a driving action of a first motor into an angular displacement of the first shaft relative to the second shaft.

4. The method for adjusting an inking device as recited in claim 3 further comprising transmitting a driving action of a second motor into an angular displacement of the first shaft relative to the second shaft.

5. The method for adjusting an inking device as recited in claim 3 further comprising displacing one end of the pick-up roller radially relative to the second shaft.

6. The method for adjusting an inking device as recited in claim 2 wherein the controller includes a manual controller.

7. The method for adjusting an inking device as recited in claim 6 wherein the manual controller includes a micrometer screw.

8. The method for adjusting an inking device as recited in claim 1 further comprising positioning the ink film pick-up roller relative to the inking roller as a function of the output signal via a controller.

9. The method for adjusting an inking device as recited in claim 8 further comprising transmitting a driving action of a first motor into an angular displacement of the first shaft relative to the second shaft.

10. The method for adjusting an inking device as recited in claim 8 wherein the controller includes a manual controller.

11. The method for adjusting an inking device as recited in claim 1 further comprising indicating a density of the ink printed on a medium to be printed in at least two different locations over the printing width.

12. The method for adjusting an inking device as recited in claim 1 further comprising adjusting a thickness of the ink on the inking roller.

13. The method for adjusting an inking device as recited in claim 12 further comprising detecting a position of the adjustment screws.

14. The method for adjusting an inking device as recited in claim 13 wherein the position of at least one of the adjustment screws corresponds to the lithographic offset value.

15. The method for adjusting an inking device as recited in claim 14 further comprising storing a value in the memory which represents a lithographic offset position when the shafts of the inking roller and pick-up roller are parallel.

16. The method as recited in claim 1, further comprising:

verifying whether the actual angular displacement is greater than a threshold displacement and/or verifying whether the actual distance is greater than a threshold distance; and implementing the displacing step only when the actual angular displacement is greater than the threshold displacement and/or when the actual distance is greater than the threshold distance.

17. The method as recited in claim 1 wherein the step of determining a lithographic offset value occurs after the displacing step.

18. A method for adjusting an inking device comprising the steps of:

providing a reservoir of ink and an ink film pick-up roller having a first shaft;

transferring ink using an inking fountain roller, which defines a printing width, from the ink reservoir to the ink film pick-up roller, the inking fountain roller being in contact with the ink in the reservoir and the ink film pick-up roller, the inking roller having a second shaft;

evaluating with a detector the actual distance between the inking fountain roller and the ink film pick-up roller within the printing width and/or of detecting an angular displacement of the first and second shafts relative to each other and providing an output signal representing the angular displacement;

determining the actual distance between the ink film pick-up roller and inking roller at least at two points of the printing width and/or determining the actual angular displacement of the first shaft and second shaft relative to each other;

displacing the first shaft relative to the second shaft by reducing the actual angular displacement and/or by modifying the relative radial position of the first shaft relative to the second shaft; and converting lithographic offset values OLCF and OLCC into distances ϵCF and ϵCC, respectively, between the ink film pick-up roller and the inking fountain roller at the two ends of a printing width, the OLCF being the lithographic offset value at one end of the printing width and the OLCC being the lithographic offset value at the other end of the printing width.

19. The method as recited in claim 18 wherein the values of the distances ϵCF and ϵCC are calculated using the following formula, $$\epsilon X = a.\text{OffsetLithographic } OLX[\%] + b$$

where a and b are constant values characteristic of the opening of the inker and are determined for each inking device, and X is either CF or CC.

20. The method as recited in claim 19 further comprising the step of calculating the actual angular displacement α between the first and second shafts using the following formula, $$\alpha = \tan\left(\frac{\varepsilon CF - \varepsilon CC}{L}\right)^{-1}.$$

21. The method as recited in claim 20 further comprising the step of converting the angular displacement α or the distances ϵCF and ϵCC into a signal and transmitting this signal via a control line to a microcontroller.

* * * * *